US010612853B2

(12) United States Patent
Kawahara

(10) Patent No.: US 10,612,853 B2
(45) Date of Patent: Apr. 7, 2020

(54) HEATING DEVICE

(71) Applicant: TOYODA IRON WORKS CO., LTD., Toyota-shi, Aichi (JP)

(72) Inventor: Nobuyuki Kawahara, Toyota (JP)

(73) Assignee: TOYODA IRON WORKS CO., LTD., Toyota-shi (JP)

( * ) Notice: Subject to any disclaimer, the term of this patent is extended or adjusted under 35 U.S.C. 154(b) by 108 days.

(21) Appl. No.: 15/768,644

(22) PCT Filed: Oct. 14, 2016

(86) PCT No.: PCT/JP2016/080478
§ 371 (c)(1),
(2) Date: Apr. 16, 2018

(87) PCT Pub. No.: WO2017/065252
PCT Pub. Date: Apr. 20, 2017

(65) Prior Publication Data

US 2018/0313608 A1 Nov. 1, 2018

(30) Foreign Application Priority Data

Oct. 15, 2015 (JP) ..... 2015-203650

(51) Int. Cl.
*F27D 5/00* (2006.01)
*C21D 1/673* (2006.01)
(Continued)

(52) U.S. Cl.
CPC ..... *F27D 5/00* (2013.01); *C21D 1/00* (2013.01); *C21D 1/673* (2013.01); *C21D 9/00* (2013.01);
(Continued)

(58) Field of Classification Search
CPC ..... F27D 5/00
See application file for complete search history.

(56) References Cited

U.S. PATENT DOCUMENTS 3,588,059 A * 6/1971 Laturell ..... F27D 3/022 432/234
3,739,921 A * 6/1973 Schmidt ..... F16B 7/00 211/194
(Continued)

FOREIGN PATENT DOCUMENTS

CN 1485660 A 3/2004
CN 102234707 A 11/2011
(Continued)

OTHER PUBLICATIONS

Dec. 20, 2016 Search Report issued in International Patent Application No. PCT/JP2016/080478.
(Continued)

*Primary Examiner* — Nathaniel Herzfeld
(74) *Attorney, Agent, or Firm* — Oliff PLC

(57) ABSTRACT

Embodiments include a heating device for heating a workpiece, comprising a furnace defining a closed space insulated from exterior and surrounded by a heat insulator, a heater disposed in the furnace to heat a workpiece, at least one support element for supporting a workpiece in the furnace, and a base holding the at least one support element. The base may comprise a mounting portion, a support element retaining portion for each support element, the retaining portion horizontally offset from the mounting portion, and a reinforcement portion configured to increase the strength of the base against deformation due to a load of the workpiece and/or support element applied through the support element retaining portion.

4 Claims, 5 Drawing Sheets

(51) Int. Cl.

| | |
|---|---|
| ***C21D 1/00*** | (2006.01) |
| ***C21D 9/00*** | (2006.01) |
| *C21D 1/18* | (2006.01) |

(52) U.S. Cl.
CPC ..... *C21D 1/18* (2013.01); *F27D 2005/0081* (2013.01)

(56) References Cited

U.S. PATENT DOCUMENTS

| | | | | |
|---|---|---|---|---|
| 6,401,941 | B1 | 6/2002 | Maumus | |
| 9,127,886 | B2 | 9/2015 | Hayashi et al. | |
| 9,359,654 | B2 | 6/2016 | Katsumata et al. | |
| 10,030,910 | B2 | 7/2018 | Esjunin et al. | |
| 2013/0032977 | A1 | 2/2013 | Katsumata et al. | |
| 2015/0099236 | A1* | 4/2015 | Esjunin ..... | F27D 3/0021 432/258 |

FOREIGN PATENT DOCUMENTS

| | | | | |
|---|---|---|---|---|
| EP | 0 330 866 | A1 | | 9/1989 |
| FR | 2 793 311 | A1 | | 11/2000 |
| JP | 2001123219 | A | * | 5/2001 |
| JP | 2003-21468 | A | | 1/2003 |
| JP | 2004-091894 | A | | 3/2004 |
| JP | 2007-333272 | A | | 12/2007 |
| JP | 2008-291284 | A | | 12/2008 |
| JP | 2014-34689 | A | | 2/2014 |
| JP | 2014-77565 | A | | 5/2014 |
| WO | 2011/129340 | A1 | | 10/2011 |

OTHER PUBLICATIONS

Feb. 5, 2019 Extended European Search Report issued in European Patent Application No. 16855505.0.
Jan. 24, 2019 Office Action issued in Chinese Patent Application No. 201680059842.01.

* cited by examiner

HEATING DEVICE

FIELD OF INVENTION

The present invention relates to a heating device used in hot press processes.

DESCRIPTION OF THE RELATED ART

Known methods of manufacturing high strength pressed parts of a vehicle include hot pressing. In a hot pressing process, a high tensile steel sheet may be heated to a temperature of about 900° C., and then simultaneously press formed and rapidly cooled between pressing dies of a low temperature to produce a quenched product (see Japanese Patent Application Publication No. 2008-291284).

In general, the hot pressing include continuously heating a number of steel sheets in a furnace for improving the thermal efficiency.

SUMMARY OF THE INVENTION

However, the continuous heating exposes components of the furnace to the high temperature for a long time, which may cause components with low heat resistance to deform by creep. When the bases for the support elements that support workpieces such as steel sheets in the furnace is deformed by creep under the weight of the workpieces, various problems arise.

For example, when placing an unheated workpiece on the support elements, the transfer device cannot lower the workpiece down to the level of the support elements, which have been lowered by the deformation of the bases, and therefore cannot transfer the workpiece onto the support elements. In addition, when taking the heated workpiece off from the support elements by a transfer device, the transfer device cannot insert the manipulator under the workpiece.

There is thus a need to increase the strength of the bases against the deformation to reduce creep deformation of the bases when the bases are exposed to a high temperature for a long time in the furnace.

The present invention in one aspect provides a heating device for heating a workpiece, comprising a furnace defining a closed space insulated from exterior and surrounded by a heat insulator, a heater disposed in the furnace to heat a workpiece, at least one support element for supporting a workpiece in the furnace, and a base holding the at least one support element. The base may comprise a mounting portion, a support element retaining portion for each support element, the retaining portion horizontally offset from the mounting portion, and a reinforcement portion configured to increase the strength of the base against deformation due to a load of the workpiece and/or support element applied through the support element retaining portion. In some embodiments, the base may be directly mounted to a wall of the furnace or indirectly mounted to the wall via an intervening structure. In the above configuration, the base is easily deformed under the load of the workpieces and/or support elements. However, in some embodiments, the reinforcement portion which is located at regions in the base that is subject to loading prevents such deformation when the base is exposed to the high temperature for a long time in the furnace to become susceptible to deformation.

In one embodiment of the invention, the base may further comprise a bearing surface supporting the support element, and the reinforcement portion may be configured to increase the flexural strength of the bearing surface of the base. In some embodiments, this prevents deformation of the base even when the base is exposed to the high temperature for a long time in the furnace and becomes readily deformable.

In one embodiment, the at least one support element may comprise two horizontally spaced bars arranged in the furnace, and the base may further comprise a planar portion that is horizontally planar and supports an end of each of the two bars on its lower side by the respective support element retaining portion, and a columnar portion extending downward from a part of the planar portion between the bars, the columnar portion forming the mounting portion. In one embodiment, the reinforcement portion may comprise a pair of ribs extending upward or downward from the planar portion on opposite sides of the columnar portion, each rib extending continuously along the direction in which the two bars are spaced. In this configuration, the planar portion of the base is subject to a bending moment such that the side portions, which support the support elements, deflect downward with respect to the columnar portion. In some embodiments, the ribs, serving as reinforcement portions, may increase the flexural strength of the planar portion, particularly that in the direction in which the two bars are arranged, thereby preventing the planar portion of the base subjected to a bending moment from being deformed by creep when the heating device is operated for a long time.

In one embodiment, the ribs may extend downward from the planar portion. In some embodiments, the direction of the ribs and that of the two bars cross each other. The configuration described above, however, increases the degree of freedom in designing the ribs and bars without interference with the two bars located above the planar portion.

In another embodiment, on the planar portion of the base each support element retaining portion may be offset from the columnar portion in the longitudinal direction of the bars, and the device may further comprise for each bar a post disposed below the planar portion at a place corresponding to the end of the bar. The planar portion is supported via the posts by, for example, a wall of the furnace. In order to support the planar portion, the post may rest directly on the wall of the furnace, or rest on the upper side of an intervening structure supported by the wall of the furnace. In this configuration, the planar portion is subject to a bending moment such as to deflect the lateral parts that support the ends of the two bars downward with respect to the columnar portion. However, in some embodiments, the posts that support the planar portion at the places corresponding to the ends of the two bars on the wall of the furnace prevent the planar portion of the base subjected to the bending moment from creep deformation when the heating device is operated for a long time.

In one embodiment, the post may be made of a material having a higher heat resistance than the base. In some embodiments, this maintains the function of the post preventing deformation of the planar portion of the base when the post is exposed to the high temperature for a long time in the furnace.

DETAILED DESCRIPTION OF THE INVENTION

Embodiments of the present invention will be described below with reference to the drawings. In one embodiment, the present invention can be applied to a heating device including a furnace used in hot pressing processes. Directions with respect to the heating device as installed on a base plate is indicated in each figure with arrow signs. In the following, the directional descriptions will be made with reference to these directions. When specifying directions, the inlet side may also be referred to as "front" and the outlet side as "rear" for convenience of description.

Figure 1:
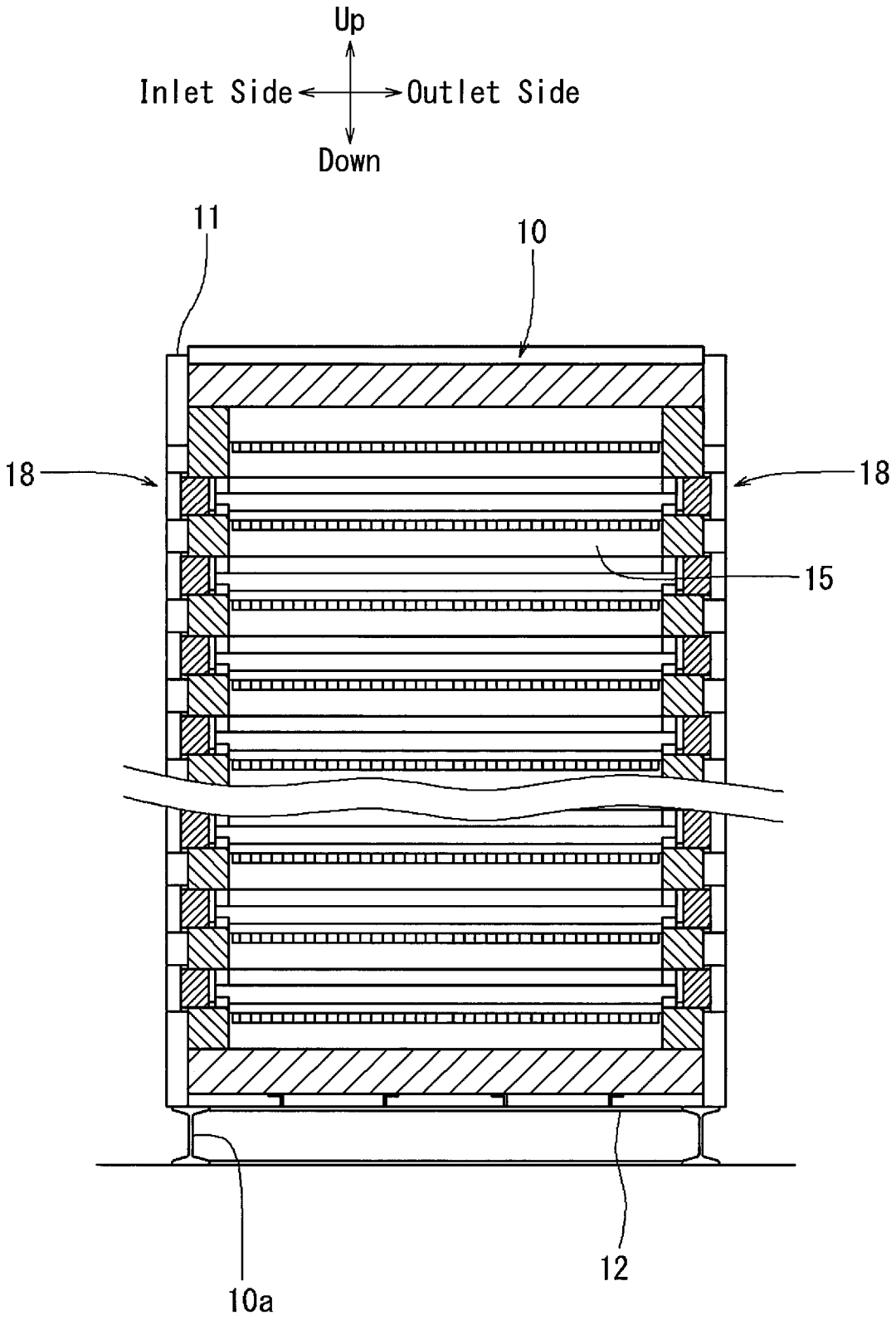
FIG. 1 is a side sectional view of a heating device including a multi-stage furnace according to one embodiment of the present invention.
Figure 2:
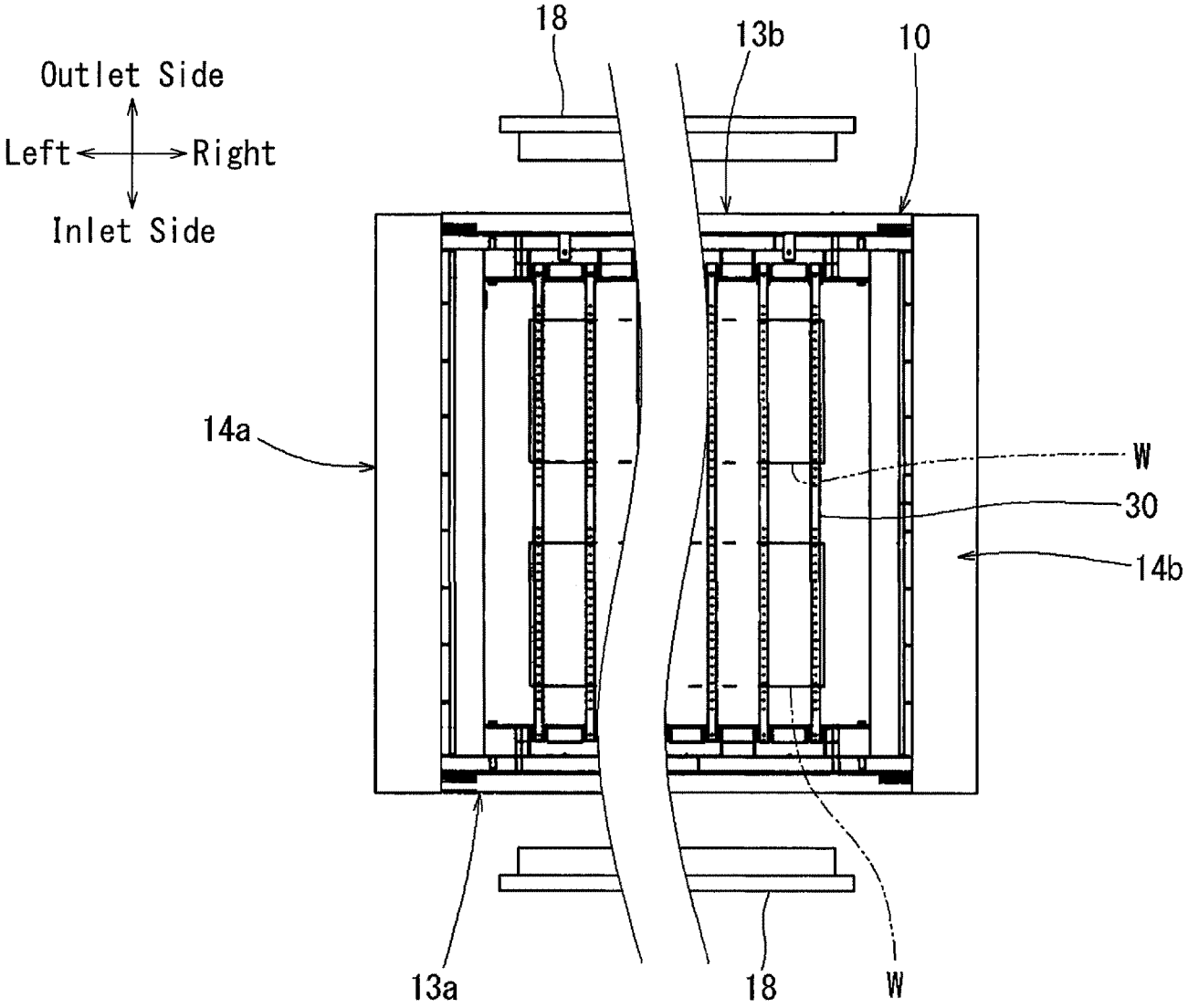
FIG. 2 is a plan sectional view of the heating device of FIG. 1.

As shown in FIGS. 1 and 2, the furnace 10 comprises an integrated stack of a plurality of single-stage units between a top frame 11 and a bottom frame 12. The furnace 10 may accommodate as many sets of workpieces W vertically as the single-stage units, each set including two placed in front and rear positions, and can heat them at the same time. The number of single-stage units to be stacked is determined by the number of workpieces W to be accommodated vertically, and the width and depth dimensions of the furnace 10 is determined by the number and size of workpieces W to be accommodated from the front to the rear. Under the bottom frame 12 there may be a support frame 10*a* by which the furnace 10 is supported on the base plate.

Each single-stage unit may comprise a box-shaped combination of an inlet side plate 13*a*, an outlet side plate 13*b*, a left side frame 14*a* and a right side frame 14*b*, and an arrangement of heater supporting plates 15 each extending from the front to the rear between the inlet side plate 13*a* and the outlet side plate 13*b*. In FIG. 2, the heater supporting plate 15 is hidden below the support elements 30 which support the workpieces W.

Figure 3:
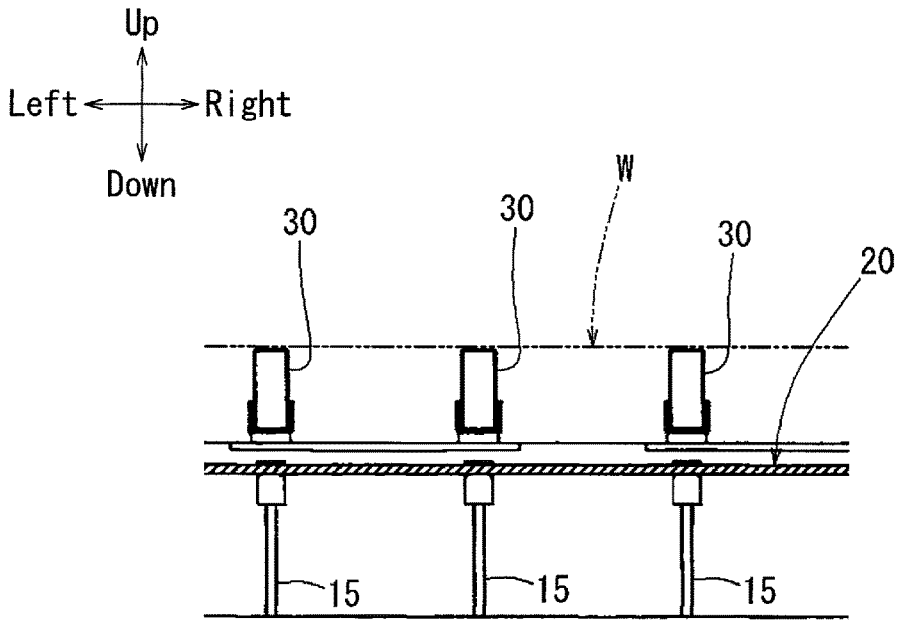
FIG. 3 is an enlarged front view of workpiece support elements and a heater in a heating device.

As shown in FIG. 3, a planar heater 20 is placed over the heater supporting plates 15. The interface between the heater supporting plate 15 and the heater 20 is electrically insulated. The heater 20 may be an electric coil heater, a radiant tube or any other heater, powered via the left side frame 14*a* and right side frame 14*b*.

Figure 4:
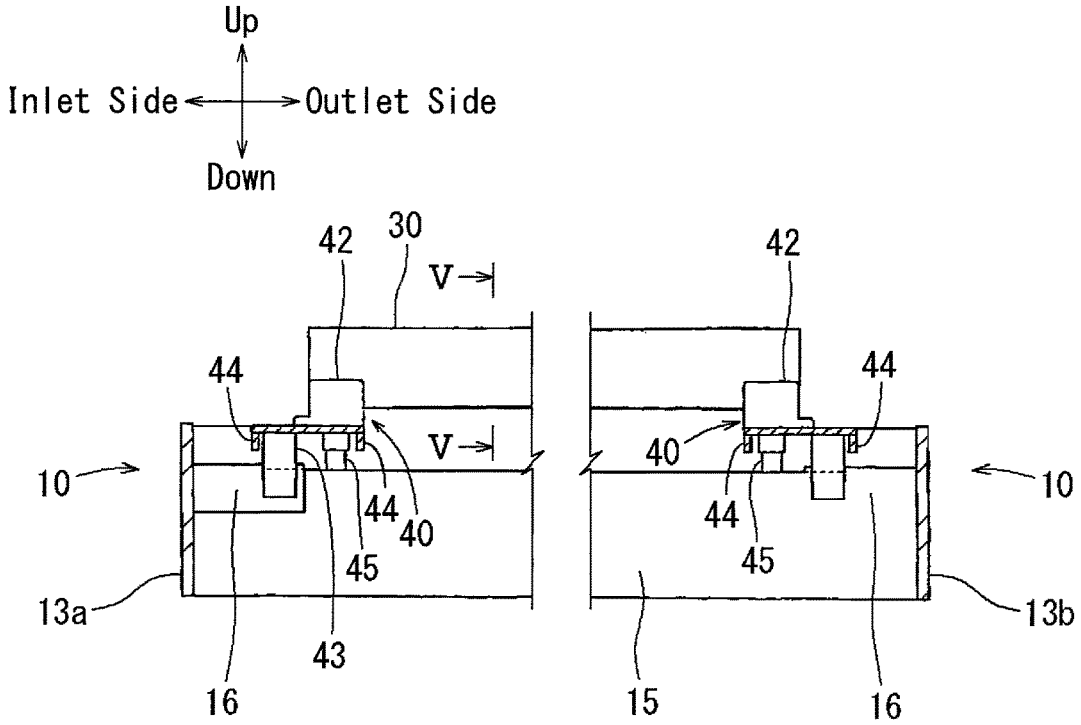
FIG. 4 is an enlarged side view of base portions on the inlet and outlet sides of a heating device.

As shown in FIGS. 3 and 4, in order to support workpieces W, a plurality of support elements 30, which may be bars of a heat-resistant metal (e.g. SUS310S), oriented front to rear, are arranged from left to right, each positioned above the respective heater supporting plate 15.

Each support element 30 may be a rectangular tube and extends between the inlet side plate 13*a* and the outlet side plate 13*b*, similarly to the heater supporting plates 15. More specifically, as shown in FIG. 4, each support elements 30 is mounted at its ends to the inlet side plate 13*a* and the outlet side plate 13*b* via bases 40.

Figure 6:
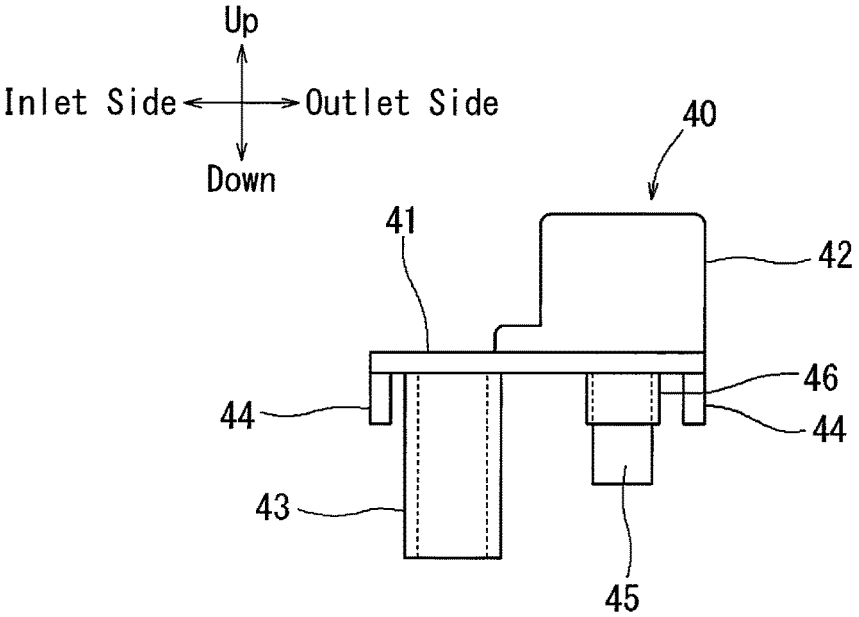
FIG. 6 is a side view of a base in a heating device in isolation.
Figure 7:
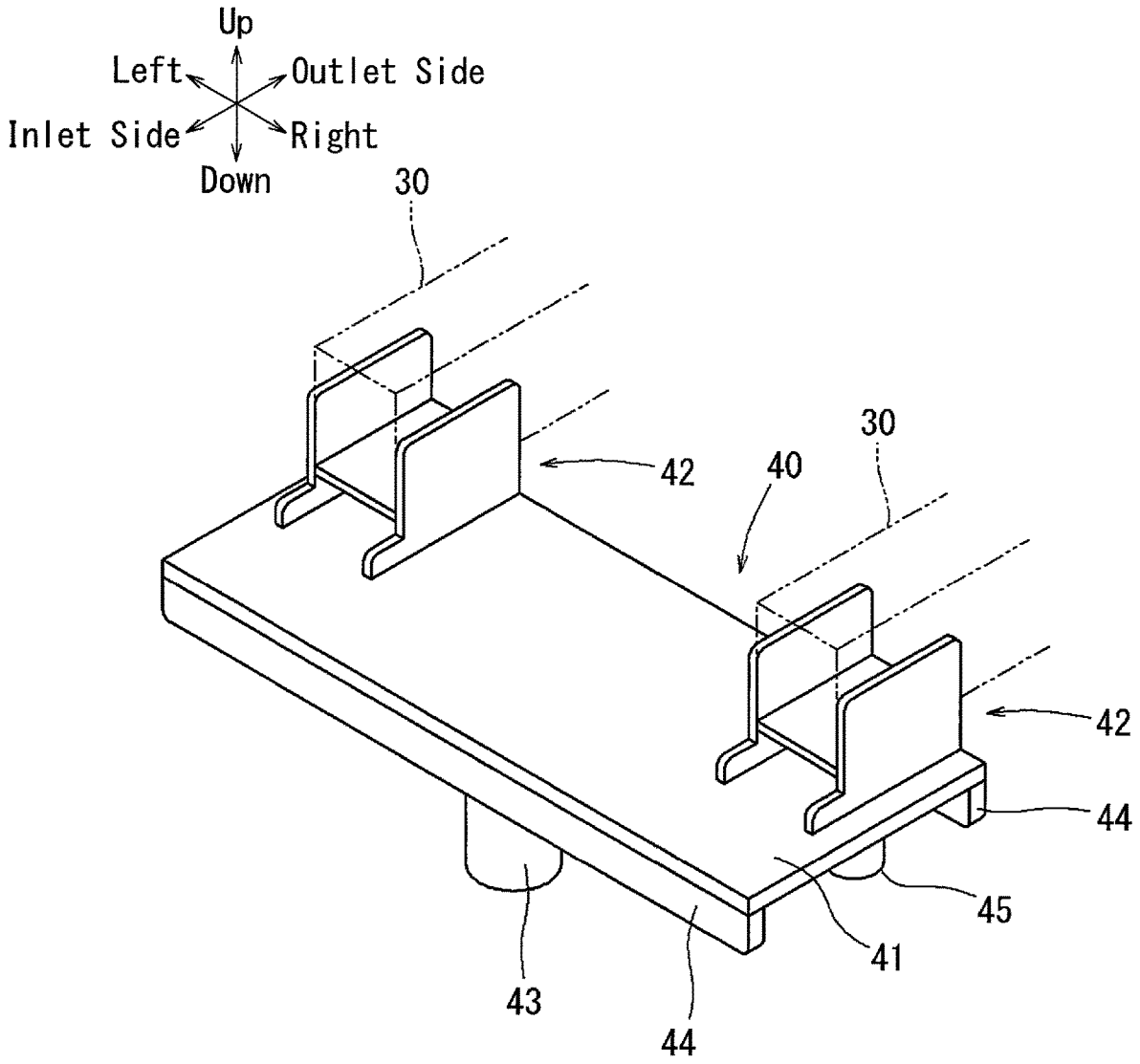
FIG. 7 is a perspective view of a base in a heating device in isolation.

FIGS. 6 and 7 show the base 40. The base 40 has a planar portion 41 which is horizontally planar and supports an end of each of two support elements 30 on its lower side on a single continuous bearing surface. To this end, the planar portion 41 has two support element retaining portions 42 holding an end of each of the two support elements 30. While the base 40 holding one end of each of the two support elements 30 has been described here, the base holding the other end of each support element 30 may also have the same configuration, for which the detailed descriptions are omitted. In this manner, the support elements 30 are in pairs, with the end of each pair held by a single base 40. In other embodiments, however, each base 40 may support a single support element 30.

Figure 5:
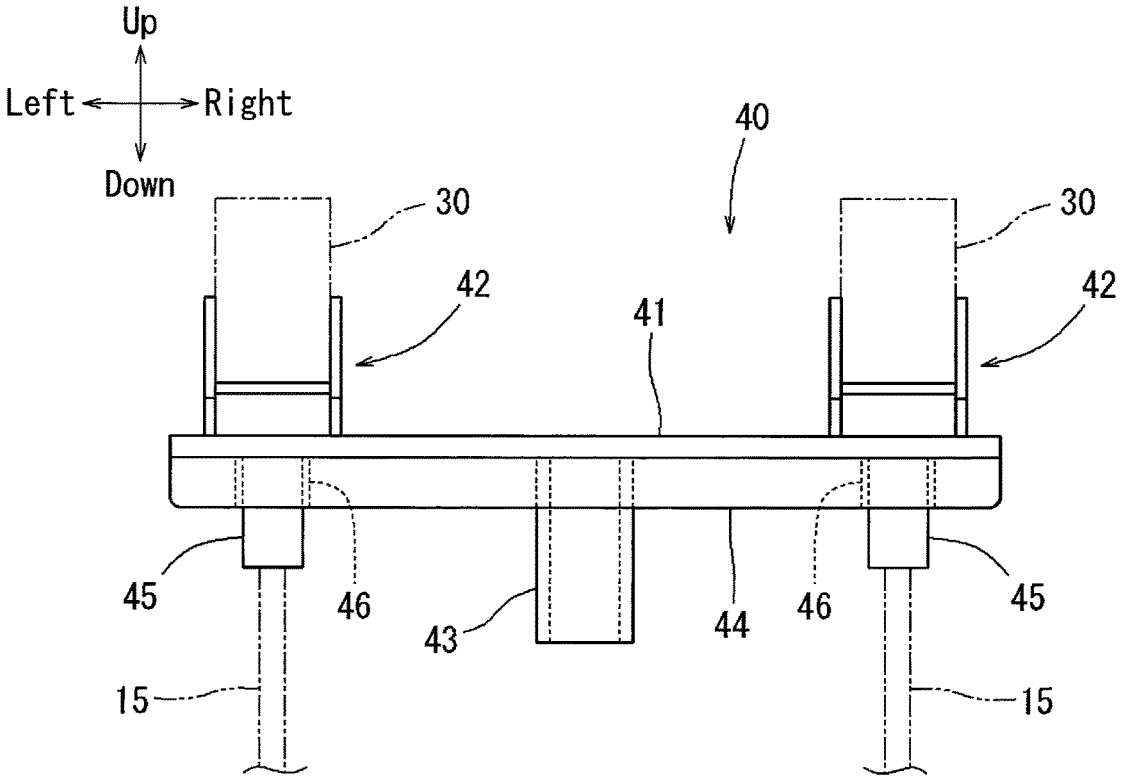
FIG. 5 is an enlarged front view of the base portions of FIG. 4.

As shown in FIGS. 4 and 5, the planar portion 41 may be integrated with a columnar portion 43 which connects a portion of the planar portion 41 that is between the two support element retaining portions 42 to an edge plate 16 that is secured onto the surface of the inlet side plate 13*a*. The base 40 is thus indirectly mounted to the wall (e.g. the inlet side plate 13*a*) of the furnace 10. The other end of the support element 30 may have the same structure for being mounted to the outlet side plate 13*b* via the base 40.

The planar portion 41 includes a pair of ribs 44 integrally formed on the lower side, the ribs being an example of reinforcement portions. The ribs 44 are located on opposite sides of the columnar portion 43 and extends continuously along the direction in which the two support element retaining portions 42 are spaced. The rib 44 on the planar portion 41 increases the flexural strength of the planar portion 41. As a result, the strength of the planar portion 41 increases against the load (or bending moment) that the left and right sides of the planar portion 41 are deflected downward about the columnar portion 43 by the weight of the two support elements 30 received by the support element retaining portions 42. This prevents the planar portion 41 of the base 40 subjected to the bending moment from creep deformation when the heating device is operated for a long time.

In other embodiments, the ribs 44 may be located on the upper side of the planar portion 41. However, when the ribs 44 are formed on the upper side of the planar portion 41, the two support element retaining portions 42 are provided on the upper side of the planar portion 41, so the rib 44 and the two support element retaining portions 42 design considerations are required so as not to interfere with each other. On the other hand, in the case where the rib 44 is formed on the lower side of the planar portion 41, such a consideration is not required, and there is an advantage that the degree of freedom in designing the rib 44 and the two support element retaining portions 42 is increased. Further, in some embodiments, only one rib 44 may be provided on the planar portion 41 of the base 40, or three or more ribs 44 may be provided. Further, in other embodiments, the plurality of ribs 44 may extend in two or three different directions crossing each other instead of extending in the same direction as described above.

On the lower side of the planar portion 41, cylindrical posts 45 made of a ceramic with a higher heat resistance than metals are provided at the places of the two support element retaining portions 42. Each post 45 is fitted and secured into a retainer sleeve 46 that is integral to the lower side of the planar portion 41. The lower end of the post 45 is in turn supported on the upper edge of the heater supporting plate 15. In some embodiments, the planar portion 41 of the base 40 may be provided with only one of the rib 44 and the pair of posts 45.

As described above, the planar portion 41 is reinforced by the ribs 44 against the downward deflection of the places of the two support element retaining portions 42 with respect to the columnar portion 43. However, on the planar portion 41 the two support element retaining portions 42 are offset from the columnar portion 43 in the direction of the support elements 30 (i.e. along the length of the support elements 30), so the planar portion 41 is subject to forces such as to deflect the places of the two support element retaining portions 42 downward with respect to the columnar portion 43. The planar portion 41 is supported at the places of the two support element retaining portions 42 against such forces by the posts 45 on the heater supporting plate 15, which reduces the creep deformation of the planar portion 41 when the planar portion 41 is susceptible to deformation due to the exposure to the high temperature. The planar portion 41 is supported at the places of the two support element retaining portions 42 by resting on the heater supporting plate 15, which in turn is secured to the wall surface of the inlet side plate 13*a* or outlet side plate 13*b;* therefore, the planar portion 41 is supported at the places of the two support element retaining portions 42 by the walls of the furnace 10.

As shown as hatched areas in FIG. 1, heat insulators are disposed around each single-stage unit, on the lower surface of the top frame 11 and on the upper surface of the bottom frame 12. The furnace is surrounded by heat insulators 10 to have a closed space insulated from the exterior.

As shown in FIGS. 1 and 2, each single-stage unit has a shutter 18 on each of the inlet and outlet sides for opening and closing the furnace 10 with respect to the exterior; the shutters are situated between the single-stage units, between the top frame 11 and the single-stage units, and between the bottom frame 12 and the single-stage units. Specifically, the shutters 18 on each single-stage unit are configured to be vertically opened and closed with respect to the left side frame 14*a* and the right side frame 14*b*. A heat insulator is also disposed on the inner surface of the shutter 18.

In use of the heating device described above in a hot pressing process, the heater 20 is energized to generate heat, the shutters 18 on the inlet side are sequentially opened, a workpiece W is transferred into each single-stage unit, as shown in FIGS. 2 and 3, and then the shutters 18 are closed. When the workpiece W on the support elements 30 has been heated to a predetermined temperature of about 900° C. by the heater 20, the shutters 18 on the outlet side are sequentially opened, and the workpiece W is taken off from the support elements 30 in each single-stage unit. In the next step, the extracted workpiece W is simultaneously press formed and quenched.

While specific embodiments of the present invention have been described above, the embodiments of the present invention are not limited to the appearances and configurations shown in the above description and the drawings, and those skilled in the art will appreciate that various modifications, additions and deletions.

The invention claimed is:

1. A heating device for heating a workpiece, comprising:

a furnace defining a closed space insulated from exterior and surrounded by a heat insulator, the furnace having a sidewall;

a heater disposed in the furnace to heat a workpiece;

at least one support element for supporting a workpiece in the furnace; the at least one support element comprising two horizontally spaced bars arranged in the furnace; and a base holding the at least one of the bars, the base comprising:

a planar portion that is horizontally planar and supports an end of each of the two bars on lower side of the bars by the respective support element retaining portion;

a columnar mounting portion supported by the sidewall, the columnar mounting portion extending downward from a part of the planar portion between the bars;

a support element retaining portion for each bar, the retaining portion horizontally offset from the columnar mounting portion; and a reinforcement portion configured to increase the flexural strength of the planar portion of the base against deformation due to a load of the workpiece and/or bars applied through the support element retaining portion, the reinforcement portion comprising a pair of ribs extending upward or downward from the planar portion on opposite sides of the columnar mounting portion, each rib extending continuously along the direction in which the two bars are spaced.

2. The heating device of claim 1, the ribs extending downward from the planar portion.

3. The heating device of claim 1, on the planar portion of the base each support element retaining portion being offset from the columnar mounting portion in the longitudinal direction of the bars, and the device further comprising for each bar a post disposed below the planar portion at a place corresponding to the end of the bar.

4. The heating device of claim 3, the post being made of a material having a higher heat resistance than the base.

* * * * *